US011732542B2

(12) United States Patent
Hughes

(10) Patent No.: US 11,732,542 B2
(45) Date of Patent: Aug. 22, 2023

(54) ANNULAR PRESSURE CONTROL RAM DIVERTER

(71) Applicant: Hughes Tool Company LLC, Highlands Ranch, CO (US)

(72) Inventor: William James Hughes, Highlands Ranch, CO (US)

(73) Assignee: Hughes Tool Company LLC, Highlands Ranch, CO (US)

( * ) Notice: Subject to any disclaimer, the term of this patent is extended or adjusted under 35 U.S.C. 154(b) by 0 days.

(21) Appl. No.: 18/082,332

(22) Filed: Dec. 15, 2022

(65) Prior Publication Data

US 2023/0131856 A1 Apr. 27, 2023

Related U.S. Application Data

(63) Continuation-in-part of application No. 17/480,114, filed on Sep. 20, 2021, now abandoned.

(51) Int. Cl.
*E21B 33/06* (2006.01)

(52) U.S. Cl.
CPC ..... *E21B 33/062* (2013.01)

(58) Field of Classification Search
CPC ..... E21B 33/062
USPC ..... 251/1.3
See application file for complete search history.

(56) References Cited

U.S. PATENT DOCUMENTS 1,569,247 A 1/1926 Abercrombie et al.
2,139,525 A * 12/1938 Snell ..... E21B 33/062 251/63
2,163,178 A * 6/1939 Otis ..... E21B 33/062 251/274
2,318,882 A * 5/1943 Nevill ..... E21B 33/062 277/325
2,322,269 A * 6/1943 Allen ..... E21B 33/062 251/274
2,387,106 A * 10/1945 Allen ..... E21B 33/062 251/1.3
2,542,302 A * 2/1951 Barker ..... E21B 33/0422 403/281
2,593,793 A * 4/1952 Rector ..... E21B 33/062 251/1.3
2,749,078 A * 6/1956 Losey ..... E21B 33/062 277/325

(Continued)

*Primary Examiner* — Daphne M Barry
(74) *Attorney, Agent, or Firm* — Michael D. Reilly

(57) ABSTRACT

Disclosed herein are various embodiments of an Annular Pressure Control Ram Diverter designed to be positioned below the conventional blowout preventer stack, and which will be activated during near balanced drilling operations to seal the annulus between the drill pipe and the casing. Returned drilling fluid and produced fluids are diverted up the annulus between the casing and intermediate casing and through a well head located below an all-inclusive BOP stack. The Annular Pressure Control Ram Diverter employs hydraulic rams to compress a flexible seal around the drill pipe. Some embodiments have an elliptical internal cavity which ensures that the elliptical seal elements cannot rotate. Other embodiments use ridges and grooves on the seal elements and housing to prevent rotation of the seal elements. Doors are provided on each side of the Annular Pressure Control Ram Diverter to permit changing of the seal elements.

3 Claims, 10 Drawing Sheets

(56) References Cited

U.S. PATENT DOCUMENTS

| | | | | | |
|---|---|---|---|---|---|
| 2,934,148 | A * | 4/1960 | Allaire | E21B 33/047 | 251/1.3 |
| 3,744,749 | A * | 7/1973 | Le Rouax | E21B 33/062 | 251/1.3 |
| 3,791,616 | A * | 2/1974 | Le Rouax | E21B 33/062 | 251/1.3 |
| 4,467,996 | A * | 8/1984 | Baugh | E21B 33/062 | 251/1.3 |
| 4,582,293 | A * | 4/1986 | Jones | E21B 33/062 | 251/1.3 |
| 4,589,625 | A * | 5/1986 | Jones | E21B 33/062 | 251/1.3 |
| 4,938,290 | A * | 7/1990 | Leggett | E21B 33/062 | 166/387 |
| 5,009,289 | A * | 4/1991 | Nance | E21B 19/10 | 294/102.2 |
| 6,543,546 | B2 * | 4/2003 | Kaiser | E21B 41/0021 | 188/67 |
| 7,270,190 | B2 * | 9/2007 | McWhorter | E21B 19/22 | 166/382 |
| 11,255,144 | B2 | 2/2022 | Hughes | | |
| 11,377,919 | B2 | 7/2022 | Hughes | | |
| 11,441,383 | B2 | 9/2022 | Hughes | | |
| 2021/0301619 | A1 * | 9/2021 | Weaver | E21B 33/062 | |
| 2022/0090462 | A1 | 3/2022 | Hughes | | |

* cited by examiner

ANNULAR PRESSURE CONTROL RAM DIVERTER

CROSS REFERENCE TO RELATED APPLICATIONS

This application is a Continuation-in-Part of U.S. Utility patent application Ser. No. 17/480,114 filed on Sep. 20, 2021, which claimed the benefit of U.S. Provisional Patent Application No. 63/082,059, entitled "Annular Pressure Control Ram Diverter" to William James Hughes, filed on Sep. 20, 2021, and which is hereby incorporated by reference in its entirety.

This application claims the benefit of U.S. Provisional Patent Application No. 63/082,059, entitled "Annular Pressure Control Ram Diverter" to William James Hughes, filed on Sep. 23, 2020, which is hereby incorporated by reference in its entirety.

This application is related to U.S. Pat. No. 11,255,144 issued on Feb. 22, 2022, entitled "Annular Pressure Cap Drilling Method" to William James Hughes, which is hereby incorporated by reference in its entirety.

This application is related to U.S. Pat. No. 11,377,919 issued on Jul. 5, 2022, entitled "Annular Pressure Cap Drilling Method" to William James Hughes, which is hereby incorporated by reference in its entirety.

This application is related to U.S. Pat. No. 11,441,383, entitled "Annular Pressure Control Diverter" to William James Hughes, issued on 13 Sep. 2022, which is hereby incorporated by reference in its entirety.

FIELD

Various embodiments described herein relate to drilling oil and gas wells, and devices, systems and methods associated therewith.

BACKGROUND

The following descriptions and examples are not admitted to be prior art by virtue of their inclusion within this section.

When the first commercial oil wells were drilled, they were drilled to relatively shallow depths using cable tools which mechanically removed cuttings from the wellbore. Even then, the operators sometimes hit high pressure oil or gas pockets, resulting in dangerous and wasteful blowouts as the hydrocarbons escaped up the well bore. Rotary drilling was introduced in the early 1900s. See U.S. Pat. No. 930,758 to H. R. Hughes, entitled "Drill". The original Hughes Tool company's roller cone bit design forever changed how the oil and gas industry drilled wells. The rotary drill bit allowed much deeper wells to be drilled, and as the wells became deeper, the pressures encountered rose rapidly.

Rotary drilling required the circulation of drilling fluid down the drill pipe and back up the annulus between the drill pipe and the casing to lubricate and cool the drill bit and to remove the cuttings from the bottom of the well.

When conventional drilling methods are used to drill for oil and gas, precautions must be taken to avoid "blowouts", that is, the dangerous condition where the drill bit encounters a subsurface formation containing hydrocarbons under high pressure. In the early days of drilling for oil and gas, not only could a blowout send large amounts of oil or gas violently to the surface, the entire rig sometimes caught on fire. The industry quickly developed methods of drilling which prevented this type of disaster, and devices to increase safety and efficiency.

Rotary drilling, in combination with a heavy drilling fluid, was one such approach which quickly gained acceptance. By increasing the density of the drilling fluid, the total weight of the column of drilling fluid can be made to exceed the expected pressure of any hydrocarbon pockets, thus preventing blowouts. This technique was and is known as "overbalanced" drilling. As a well was drilled deeper, different formations with different fluid pressures will be encountered. It was the responsibility of the mud engineer to constantly monitor the pressures and adjust the density of the drilling fluid so that the weight of the column of mud in the wellbore exerted a pressure on the rock formation being drilled which exceeded the predicted pressure of any hydrocarbons contained within the formation. This technique has been shown to be effective in preventing blowouts caused by hitting zones of high pressure oil or gas. If the fluid was too light, blowouts could occur, but if it was too heavy, the cuttings would not efficiently be removed from the area in front of the drill bit and thus the rate of drilling would slow.

The technique is not entirely risk-free, as the "mud engineer" responsible for adjusting the density and total mud weight must be constantly monitoring the process, and mistakes can be made, resulting in blowouts. Additional protection is therefore provided for the workers on the rig floor by installing various devices to prevent the sudden and dangerous release of hydrocarbons under high pressure.

These mechanical barriers include blowout preventers such as various types of hydraulic rams which can be closed to seal off the well bore annulus, diverters to direct high pressure flow away from the rig, and others. See, for example, U.S. Pat. No. 1,569,247 to Abercrombie et al., entitled "Blow-out Preventer", for an early version of one of these devices. Several of these devices are usually installed above the wellhead in what is referred to as a "stack" or a "BOP stack". A typical stack consists of between one and six ram-type blowout preventers, and usually, one or two annular blowout preventers. Some of these devices are employed routinely when performing normal drilling operations, such as changing a drill bit. Others are used in emergencies, as a last resort, to prevent accidents and disasters.

The heavy drilling mud prevents hydrocarbons from entering the well bore and reaching the surface because the pores and fractures in the rocks rapidly become plugged with drilling fluid which was forced in under pressure, and often drawn further in by capillary action, thereby reducing the effective permeability to zero. It has been said that Howard Hughes Sr., not only invented the rotary drill bit, he inadvertently invented formation damage. That may be giving too much credit to Howard Hughes Sr., but it remains true that the goal of all drilling engineers for many years seems to have been to inflict the maximum possible formation damage and prevent the release of any hydrocarbons whatsoever during the drilling process.

Once the drilling was completed within the target hydrocarbon bearing formation, the goal of the completion engineer was totally opposite to the goal of the drilling engineer. The completion engineer always tries to achieve the maximum possible flow of hydrocarbons, which required the least possible formation damage by restoring the maximum possible porosity and permeability. These goals are hard to accomplish when the pores and fractures have been plugged by drilling mud. The proposed solution in many cases was the use of hydraulic fracturing, referred to as "fracing" within the oil and gas industry and "fracking" in the popular media. Fracing is often said to be necessary to fracture rocks which have few natural fractures. The reality is that all rocks contain natural fractures, some more than others. Industry insiders will sometimes admit, when pressed, that fracing is really an attempt to blast through the mud-plugged and damaged formation and restore a path for the hydrocarbons to flow through.

Hydraulic fracturing involves pumping fluid under very high pressure into hydrocarbon-bearing rock formations to force open cracks and fissures and allow the hydrocarbons residing therein to flow more freely. The fluid is primarily water, and may contain chemicals to improve flow, and also "proppants" (an industry term for substances such as sand). In theory, when the fracturing fluid is removed, and the hydrocarbons are allowed to flow, the sand grains prop open the fractures and prevent their collapse, which might otherwise quickly stop or reduce the flow of hydrocarbons. However, many rock types react with water and expand, further reducing the possibility of producing hydrocarbons. Yet the industry continues to use water for hydraulic fracturing operations in shale formations.

For the first 100 years and more of oil exploration and production, wells were drilled almost exclusively in geologic formations that permitted production of oil and gas flowing under the natural pressures associated with the formations. Such production required that two physical properties of the geologic formation fall within certain boundaries. The porosity of the formation had to be sufficient to allow a substantial reserve of hydrocarbons to occupy the interstices of the formation, and the permeability of the formation had to be sufficiently high that the hydrocarbons could move from a region of high pressure to a region of lower pressure, such as when hydrocarbons are extracted from a formation. Many of these reservoirs had sufficient porosity and permeability to allow the flow of hydrocarbons even after the damage inflicted by overbalanced drilling.

In recent years, it has become apparent that large reserves of hydrocarbons are to be found in shale formations. The current mindset today in the upstream oil and gas industry is that unconventional reservoirs such as shales need to be hydraulically fractured because they are tight—that is, they have low porosity and permeability. That premise is contradicted by shale reservoirs such as the Monterey in California, the Pierre in Colorado and the Marcellus in New York which were so productive in the early 1900's, long before hydraulic fracturing was ever invented. These reservoirs were drilled without overbalanced mud systems, and even though they were vertical wells they still were able to encounter a small fraction of the formation's natural fracture system. Tectonically induced natural fractures initially propagate perpendicular to the bedding plane of a formation. Over time sedimentary beds with no dip can be tilted thereby also tilting the natural fracture system within the formation so that even a vertical well is able to intersect a few natural fractures. Given the high dip of many formations in California, vertical wells are technically high angle wells based on the definition of a horizontal well which is a wellbore drilled parallel to the bedding plane of a formation and not a wellbore drilled parallel to the surface of the earth.

Many early Monterey Shale wells exceeded 10,000 BOPD without fracing. This does not fit with the current doctrine that shales are too tight to produce without fracing. When most industry professionals talk about a shale reservoir being "tight" they are generally referring to the matrix, which is a correct observation. What is not considered is the permeability contribution from natural micro and macro fractures that exists in all hard (brittle) sedimentary rocks such as shales. Determination of the "collective" permeability system is important to understanding why so-called "tight" rocks can produce without being hydraulically fractured. It should be noted that a single natural fracture with an aperture of 25 microns has over 50 Darcys of permeability.

Another trend in the last thirty years is that drilling technology has evolved to allow wells to be drilled horizontally in virtually any direction, and is no longer constrained to the drilling of vertical wells only. Deviated wells are thus often drilled horizontally through specific geologic formations to increase production potential. The extent of a hydrocarbon-producing formation in a vertical well may be measured in feet, or perhaps tens or hundreds of feet in highly productive areas. By drilling horizontally or non-vertically through a formation, the extent of the formation in contact with the wellbore can be much greater than is possible with vertically-drilled wells. Natural fractures tend to propagate in the direction of maximum stress. In formations which are essentially horizontal, the fractures tend to propagate vertically and in specific directions. Thus a horizontal well intersects the maximum number of fractures for a given distance drilled. In order to optimize the production and the useful life of the well, the natural fracture system should not be compromised by the injection of heavy drilling fluids.

What is needed are improved techniques wherein the rock formations are not damaged during the drilling process. These improved techniques will allow the production of hydrocarbons from the natural fracture systems in the rocks without the need for hydraulic fracturing. Such improved techniques will also remove the need for the millions of gallons of water, the sand, and the chemicals required by fracing operations. The improved techniques must also offer a level of safety which is at least as good, and preferably better than, traditional drilling techniques. Therefore is it necessary to modify the equipment used, including the blowout preventers, to accommodate these new techniques and provide an enhanced level of safety.

SUMMARY

In one embodiment, there is provided an Annular Pressure Control Ram Diverter for use during the drilling of a well to seal the annulus between a drill pipe and a casing surrounding the drill pipe while the drill pipe is rotating or stationary in order to divert the flow of returned drilling and produced fluids into an outer annulus, comprising: a ram blowout preventer; an internal cavity forming a seal housing within the ram blowout preventer; flexible seal elements contained within the seal housing; wherein the flexible seal elements close around the drill pipe while the drill pipe is rotating or stationary to block and seal the annulus between the drill pipe and the casing; wherein raised ridges which form a gripping surface are used to prevent rotation of the seal elements and wherein the outer surfaces of the flexible seal elements are equipped with raised ridges which grip the inner surfaces of the seal housing to prevent rotation of the seal elements.

In another embodiment, there is provided an Annular Pressure Control Ram Diverter for use during the drilling of a well to seal the annulus between a drill pipe and a casing surrounding the drill pipe while the drill pipe is rotating or stationary in order to divert the flow of returned drilling and produced fluids into an outer annulus, comprising: a ram blowout preventer; an internal cavity forming a seal housing within the ram blowout preventer; flexible seal elements contained within the seal housing; wherein the flexible seal elements close around the drill pipe while the drill pipe is rotating or stationary to block and seal the annulus between the drill pipe and the casing; wherein raised ridges which form a gripping surface are used to prevent rotation of the seal elements and wherein the inner surfaces of the seal housing are equipped with raised ridges which grip the outer surfaces of the seal elements to prevent rotation of the seal elements.

In another embodiment, there is provided an Annular Pressure Control Ram Diverter for use during the drilling of a well to seal the annulus between a drill pipe and a casing surrounding the drill pipe while the drill pipe is rotating or stationary in order to divert the flow of returned drilling and produced fluids into an outer annulus, comprising: a ram blowout preventer; an internal cavity forming a seal housing within the ram blowout preventer; flexible seal elements contained within the seal housing; wherein the flexible seal elements close around the drill pipe while the drill pipe is rotating or stationary to block and seal the annulus between the drill pipe and the casing; wherein interlocking grooves and ridges are used to prevent rotation of the seal elements and wherein the outer surfaces of the flexible seal elements are equipped with grooves which interlock with raised ridges on the inner surfaces of the seal housing to prevent rotation of the seal elements Further embodiments are disclosed herein or will become apparent to those skilled in the art after having read and understood the specification and drawings hereof.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of several illustrative embodiments when read in conjunction with the accompanying drawings, wherein:

The drawings are not necessarily to scale. Like numbers refer to like parts or steps throughout the drawings.

DETAILED DESCRIPTION OF SOME EMBODIMENTS

Figure 1B:
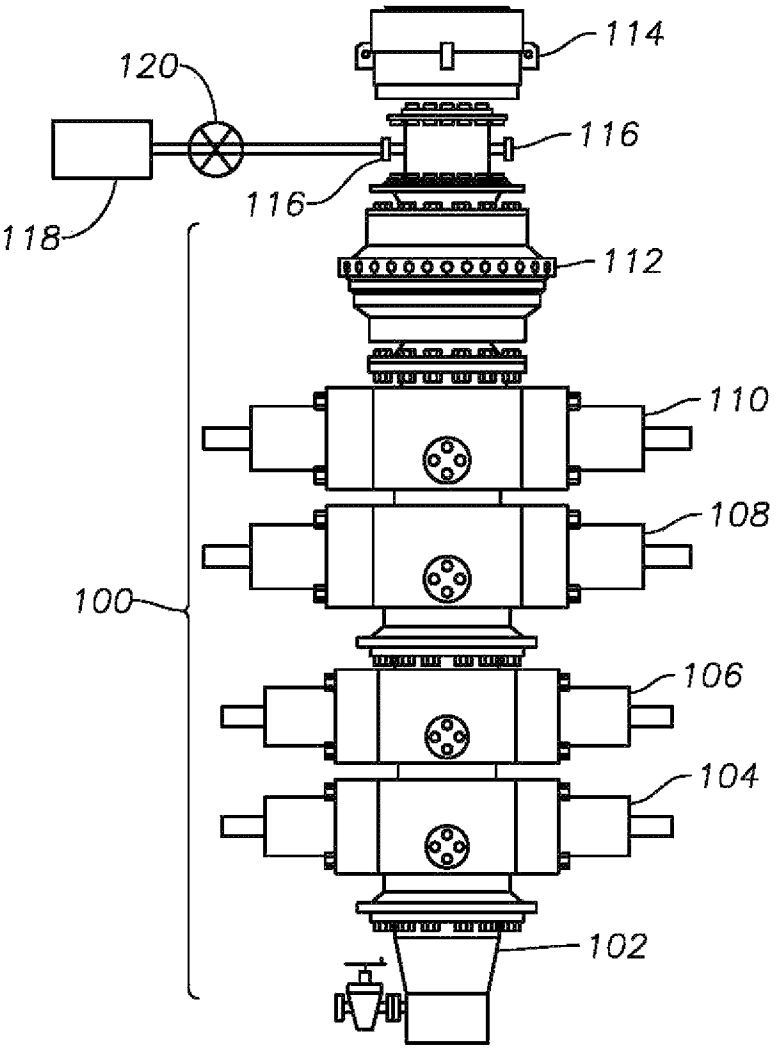
FIG. 1B (Prior Art)
FIG. 1B shows a conventional blowout preventer stack configured for underbalanced drilling operations with an RCD at the top of the stack.

In the following description, specific details are provided to impart a thorough understanding of the various embodiments of the invention. Upon having read and understood the specification, claims and drawings hereof, however, those skilled in the art will understand that some embodiments of the invention may be practiced without hewing to some of the specific details set forth herein. Moreover, to avoid obscuring the invention, some well-known methods, processes and devices and systems finding application in the various embodiments described herein are not disclosed in detail.

Referring now to the drawings, embodiments of the present invention will be described. The invention can be implemented in numerous ways. Several embodiments of the present invention are discussed below. The appended drawings illustrate only typical embodiments of the present invention and therefore are not to be considered limiting of its scope and breadth. In the drawings, some, but not all, possible embodiments are illustrated, and further may not be shown to scale.

The oil and gas industry has standards for the size of pipes and casings, and for the sizes and configurations of devices such as casing heads, blowout preventers, chokes, etc. Therefore when this specification describes such devices as being installed, one of ordinary skill in the art will understand that the devices are installed and connected using industry standard connections.

For a discussion of the issues relating to Near Balanced Reservoir Drilling, including operator safety and production while drilling, see U.S. Utility Pat. No. 11,377,919 entitled "Annular Pressure Cap Drilling Method" to Hughes, hereinafter "the "919 patent" which is hereby incorporated by reference in its entirety. It includes a description of how the devices disclosed in the current application are used to safely and efficiently drill for oil and gas.

The use of heavy drilling mud is referred to as "overbalanced" drilling, in that the weight of the drilling fluid in the wellbore exceeds the pressures expected to be encountered in the well. The result is that the drilling fluid is forced under pressure into the pores and fractures of the rock formations being drilled. This is not a problem while drilling through non-producing formations on the way to the target zone. From the perspective of the driller, it is still not a problem when the target zone is encountered. The drilling mud forms an effective barrier to prevent the hydrocarbons from entering the well bore while drilling is in progress. The problem is that the barrier is equally effective when drilling is complete and the well is turned over to the production engineers. The solution in many wells is to use hydraulic fracturing to try to clear the pores and fractures and allow hydrocarbons to flow into the wellbore.

A far better approach is to not cause the formation damage in the productive formation in the first place. In order to avoid formation damage, some drilling operations are conducted using "underbalanced" or "near balanced" drilling techniques. In underbalanced drilling ("UBD"), a light drilling fluid, such as mineral oil, is used. The weight of the column of drilling fluid is then significantly less than the expected pressures which may be encountered during drilling. In near balanced reservoir drilling ("NBRD"), the weight of the drilling fluid may approach, but is never allowed to exceed, the pressures of the hydrocarbons in the target formations. The primary difference between traditional underbalanced drilling and near balanced drilling is that traditional underbalanced drilling is overbalanced in front of the drill bit. The near balanced method is underbalanced in front of the bit because the drilling technique allows no drilling fluid to exit the drill bit. Both of these approaches avoid formation damage above the bit by not forcing drilling fluid into the pores and fractures of the formation. Both techniques expect, and plan for, the production of hydrocarbons while drilling the well.

These techniques differ from what is known as "Managed Pressure Drilling" or MPD, where the weight of the column of drilling fluid is adjusted to increase penetration rates and minimize formation damage, but is kept high enough that no hydrocarbons are produced during drilling. Therefore there will inevitably be some degree of formation damage.

Some wells are drilled using overbalanced techniques for the vertical section of the well. Then as the horizontal sections are drilled out from the vertical wellbore, the heavy drilling mud is no longer used, and underbalanced or near balanced drilling is used while drilling through the producing formation. This approach has not gained wide acceptance, in part because of reluctance to adopt new techniques, and in part because of safety concerns.

These underbalanced techniques eliminate the use of the heavy drilling mud, and therefore require an additional barrier to be positioned between the drilling rig crew and the high pressures downhole. This barrier is usually a rotating control device (RCD) installed at the top of the BOP stack. However, this is not an ideal solution, because it means that in some drilling operations the drillers and rig crew are operating in close proximity to pressures in excess of 5,000 psi. The safe adoption of underbalanced and near balanced drilling therefore requires an alternative primary pressure barrier to prevent blowouts and to reduce the danger to the rig workers from highly pressurized equipment on the rig floor. The present invention discloses such an alternative primary pressure barrier.

In order to fully appreciate the present invention, it is helpful to first discuss the different types of secondary pressure barriers, including ram BOPs, annular BOPs and RCDs, and how they are used.

Figure 1A:
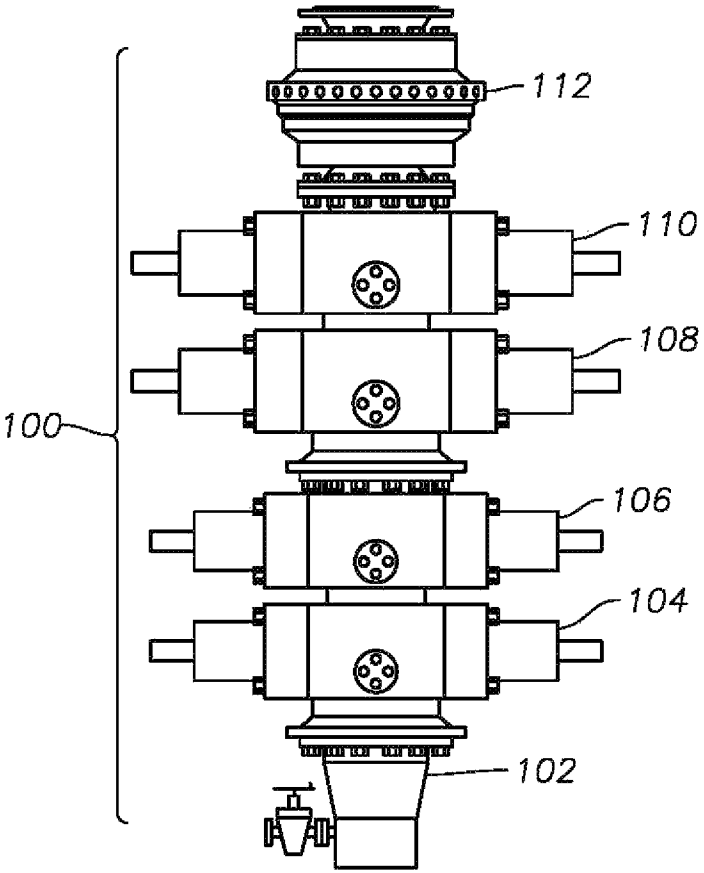
FIG. 1A (Prior Art)
FIG. 1A shows a conventional blowout preventer stack.

A typical BOP stack configuration for an overbalanced drilling operation is shown in FIG. 1A. Here the BOP stack 100 is positioned above the well head 102. During drilling operations, hydraulic ram blowout preventers may be used to close off the well for maintenance purposes, tripping the drill bit, or in case of problems. Ram-type blowout preventers are only used when drilling operations are not in progress and depending on the type, when the drill pipe is either not rotating or is not present. There are no ram-type blowout preventers currently on the market which are designed for use when the drill pipe is present and rotating.

A shear ram 104 would be used to cut through the drill pipe, and obviously is used only in emergencies. Blind rams 106 close the well bore completely when no pipe is present. Pipe rams 108 and 110 close off the annulus around the drill pipe and are used when the drill pipe is still in the well.

An annular BOP 112 is, as the name implies, intended to close off the annulus around the drill pipe. Annular BOPs are intended to be used only when the drill pipe is present but not rotating.

When the industry began to use underbalanced drilling techniques, it was recognized that not using the drilling mud column to control blowouts created a potential hazard, and some other safety mechanism was needed to provide continuous control of the pressure in the well while drilling. The solution to this problem had to be capable of functioning while the drill pipe was present, and more significantly, while it was rotating during drilling operations. The device had to be capable of sealing off the annulus around the rotating drill pipe with pressures in the well of 1,500 psi and above. The sealing element in a conventional annular BOP would quickly wear out from the friction with the rotating drill pipe. Distortion of the seal due to the torque transferred from the drill pipe could compromise the effectiveness of the seal. Additional wear and damage would occur when tripping the drill string. No drilling engineer would allow such wear on a secondary or backup safety device, which has to work reliably when needed during well control events, and seal off high pressures in an emergency. Therefore it is well understood that the annular BOP cannot be used as a substitute for the primary safety barrier of the drilling mud while the drill pipe is rotating. A new type of device was required.

The industry has developed the Rotating Control Device, known as a RCD, which also operates to close off the annulus around the drill pipe, but is intended to operate while drilling operations are in progress, that is, while the drill pipe is rotating. The sealing element which grips the drill pipe rotates with the drill pipe. While that solves the problem of wear on the inside diameter of the sealing element, the sealing element must be supported on bearings, and sometimes bearings are installed above and below the sealing element, to aid in the rotation and prevent the sealing element from wearing out. Unfortunately this creates additional problems, because the bearings wear out and must be replaced periodically.

As shown in FIG. 1B, the RCD 114 is installed at the top of the BOP stack 100. Returned drilling fluid and produced hydrocarbons flow up through the BOP stack 100 and are blocked at the top of the BOP stack 100 by the RCD 114. The flow is diverted out through a flow spool 116 and separator 118, where the drilling fluid and produced hydrocarbons and water are separated. The pressure in the BOP stack can be regulated by adjusting the drilling choke 120.

As described above, while drilling is in progress, the ram BOPs 104 through 110 and annular BOP 112 are not activated. Therefore the pressure of the fluids in the well bore is held in check only by the RCD 114 and the drilling choke 120. This exposes the operators on the rig floor to very high pressures with only the single RCD 114 between them and potential disaster. The location of the RCD 114 is a result of the constraint that in order to replace the sealing element and the bearings for the sealing element, it is necessary to remove the top of the RCD 114. This requires the RCD 114 to be placed on top of the stack.

The returning fluid contains cuttings from the drilling which are removed so that the drilling fluid can be recirculated. It will be obvious to a person of ordinary skill in the art that as the return fluid flows up through the BOP stack 100, the internal mechanisms of the rams 104, 106, 108, 110 and annular BOP 112 will trap and accumulate these cuttings from the continuous return fluid flow. When the need arises to activate the BOP devices, this buildup of detritus in their internal cavities may be an impediment to their proper operation.

A further disadvantage of this approach is seen when the BOP stack devices are activated, such as might be done during maintenance operations or changing the drill bit. If one of the devices below the RCD is activated, and then the pressure in the well drops, there will be a pocket of high pressure fluid in the BOP stack between the two activated devices. If multiple devices are activated, there may be several zones with different pressures. While this is not an insurmountable problem, care must be taken when returning to normal operations. In particular, the order in which the devices are deactivated is important, to avoid a sudden and damaging release of pressure in one of these pockets.

Many of these disadvantages of a conventional underbalanced drilling operation are addressed and overcome by the present invention. The present invention is based on the premise that the well pressure should not be controlled at the top of the BOP stack as is done with the RCD 114 in FIG. 1B. The primary pressure control mechanism in conventional drilling, the mud system, is not employed when the device described herein is used. Any substitute for mud system primary safety and control system should take its place, that is, below the BOP stack 100. The components of the BOP stack 100 can then function as intended, as a secondary safety and control system.

The present invention comprises an Annular Pressure Control Diverter, designed specifically to be positioned below the conventional BOP stack and function as the primary pressure barrier by blocking the annulus between the drill pipe and the casing. This is contrary to conventional underbalanced drilling practice, where the annular pressure control device, the RCD, is placed at the top of the conventional BOP stack. The present invention does not do away with the traditional BOP devices because they still serve their usual function as secondary blowout prevention barriers. Substituting a mechanical barrier for the mud system greatly reduces the risk of errors, and provides a reliable system for controlling pressure.

When using underbalanced or near balanced drilling techniques, hydrocarbons can, and will, flow into the well bore, when the pressure in the formation exceeds the pressure exerted by the drilling fluid. The operator must be prepared to deal with the flow of oil or gas, and with these drilling techniques, it is necessary to plan for production of oil and gas, often in significant quantities, during the drilling process. In conventional drilling operations, the returning fluids flow through up through the annulus between the drill pipe and the production tubing and then through the BOP stack. The fluids are diverted to a separator using a flow spool located below the upper RCD 114.

In the current invention, this flow path is not possible because of the presence of the Annular Pressure Control Diverter which blocks the annulus between the drill pipe and the casing aka tie-back liner. Therefore a different path must be provided for the return fluid flow. The return fluid flow, which would normally flow up through the annulus surrounding the drill pipe, is diverted through ports in the casing, aka tie-back liner, into the annulus between the production casing and the intermediate casing. No fluid flows upwards past the Annular Pressure Control Diverter. The devices above the Annular Pressure Control Diverter in the upper BOP stack are not exposed to formation pressure during normal drilling operations.

A full description of how an Annular Pressure Control Diverter is employed to drill a well using the NBRD approach, including details about how the return fluid flow is diverted, is provided in the '919 patent. After reading that application and perusing the figures, one of ordinary skill in the art will appreciate that the devices and methods described in this application operate very differently from the conventional blowout preventers which they superficially resemble, and fulfill a very different purpose.

It should be noted that the name "Annular Pressure Control Diverter" refers to the use of the device to control the pressure in the annulus between the drill pipe and the casing, and not to the method of operation of the various devices used to do so by compressing a flexible seal around the drill pipe. U.S. Utility Patent No. 11,441,383, "Annular Pressure Control Diverter" to William James Hughes, hereinafter "the '383 Patent", which is hereby incorporated by reference in its entirety, describes an Annular Pressure Control Diverter which is an annular device, wherein the seal is compressed using pressure from below the seal.

The objective of blocking the annulus as described in the '919 Patent can also be accomplished by the type of device described in this patent application, an Annular Pressure Control Ram Diverter, which will henceforth be referred to as a Ram Diverter. Such a device provides an annular seal which is compressed by applying horizontal pressure from the sides. In the embodiments described below, the objective of sealing the annulus is accomplished using a ram type diverter, which is similar to a pipe ram with the internal mechanism and seal modified to allow the device to be used while the drill pipe is rotating.

Figure 2:
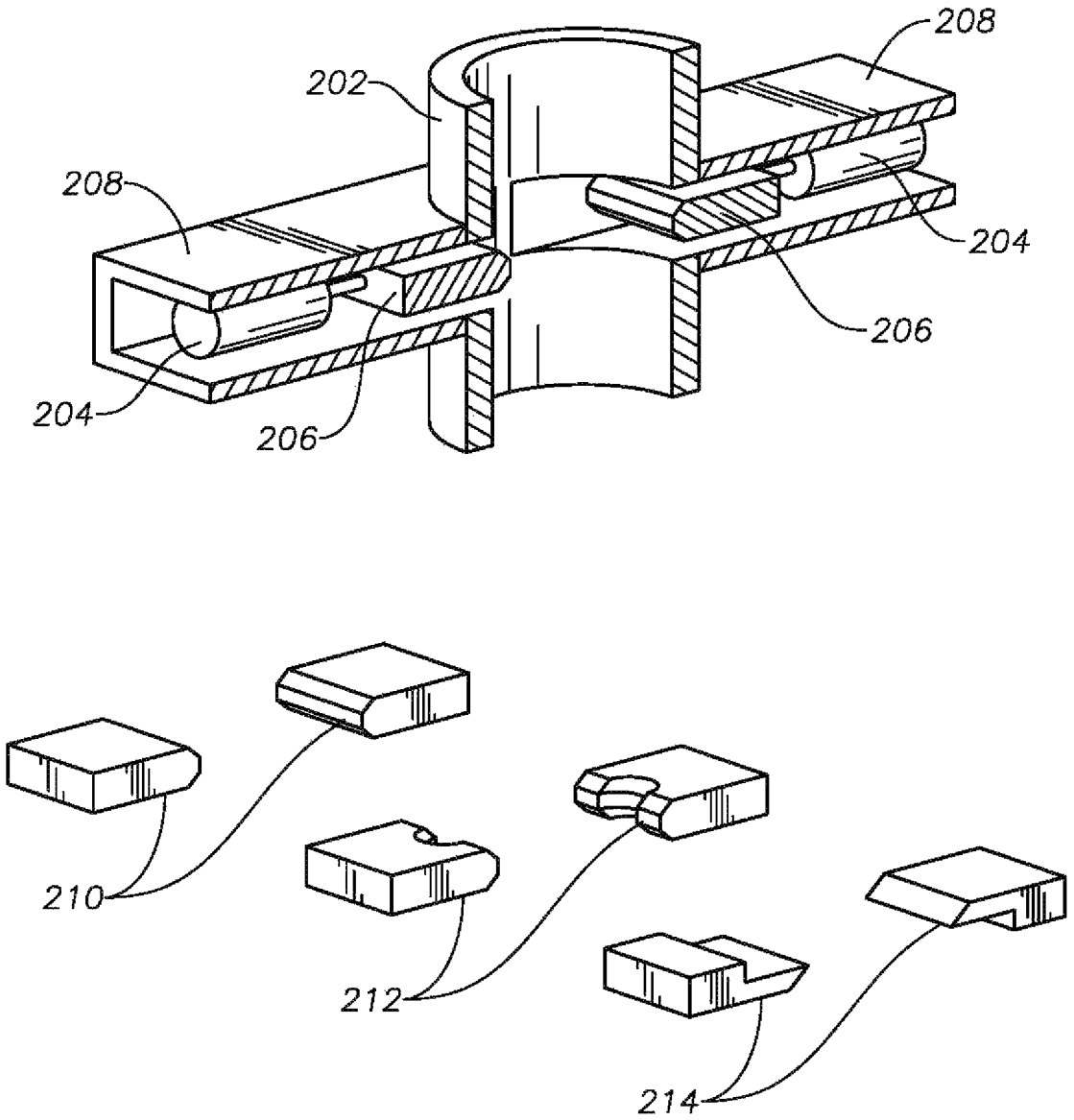
FIG. 2 shows a conceptual version of a ram BOP with several different types of ram.

For reference purposes, FIG. 2 shows a simplified diagram of a ram type of BOP. The body 202 of the BOP contains opposing hydraulic cylinders 204 which push rams 206 inwards within the supporting guides 208. Several different types of ram are shown, including blind rams 210, pipe rams 212, and shear rams 214. The purpose of these rams was explained above. All of these devices are intended to be used when the drill pipe is not rotating or is not present.

Figure 3:
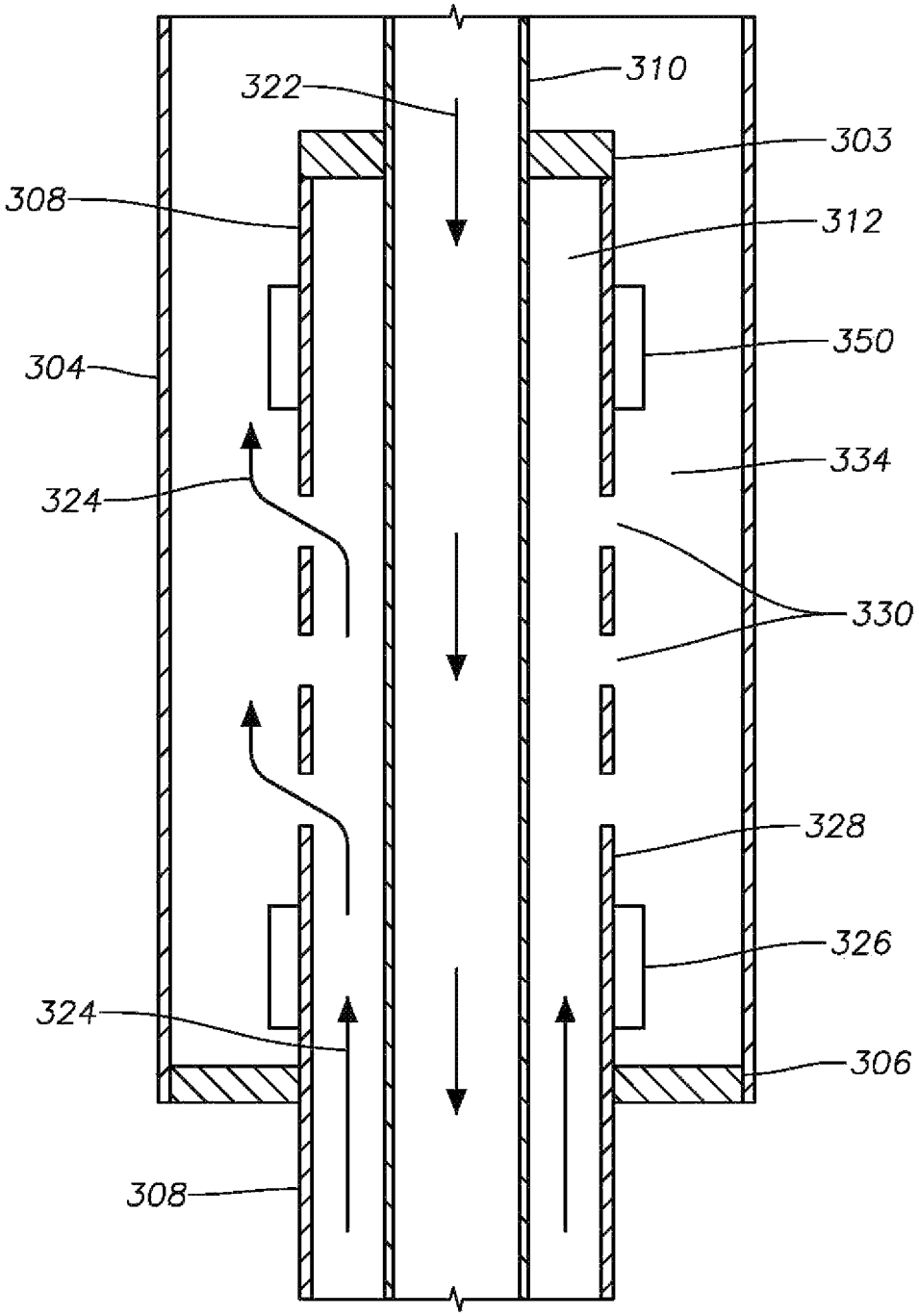
FIG. 3 shows the fluid return flow path when using an Annular Pressure Cap Drilling Diverter as the primary pressure barrier and drilling fluid returns up the annulus between the production casing and intermediate casing.

FIG. 3 is adapted from the '919 Patent to show the context in which the Ram Diverter is used. The Ram Diverter 303 is shown blocking the annulus 312 between the casing 308 and the drill pipe 310. Drilling fluid 322 is pumped down the drill pipe 310. The return flow of fluid 324, which includes the drilling fluid and cuttings, and may include produced hydrocarbons, cannot enter the upper BOP stack. Therefore an alternate path must be provided for the return flow of fluid 324. In some embodiments the '005 invention, a tie-back receptacle 326 is installed above a liner hanger 306. A section 328 of the production casing 308 above and proximate to the tie-back receptacle 326 is ported. This section 328 of the production casing is referred to as a "ported sub". The ports 330 allow the return flow of fluid 324 up the annulus 312 between the tubing 310 and the production casing 308, through the ports 330, and into the annulus 334 between the production casing 308 and intermediate casing 304. In some embodiments, one or more sub-surface safety valves 350 are installed in the production casing 308 above the ports 330.

Figure 4:
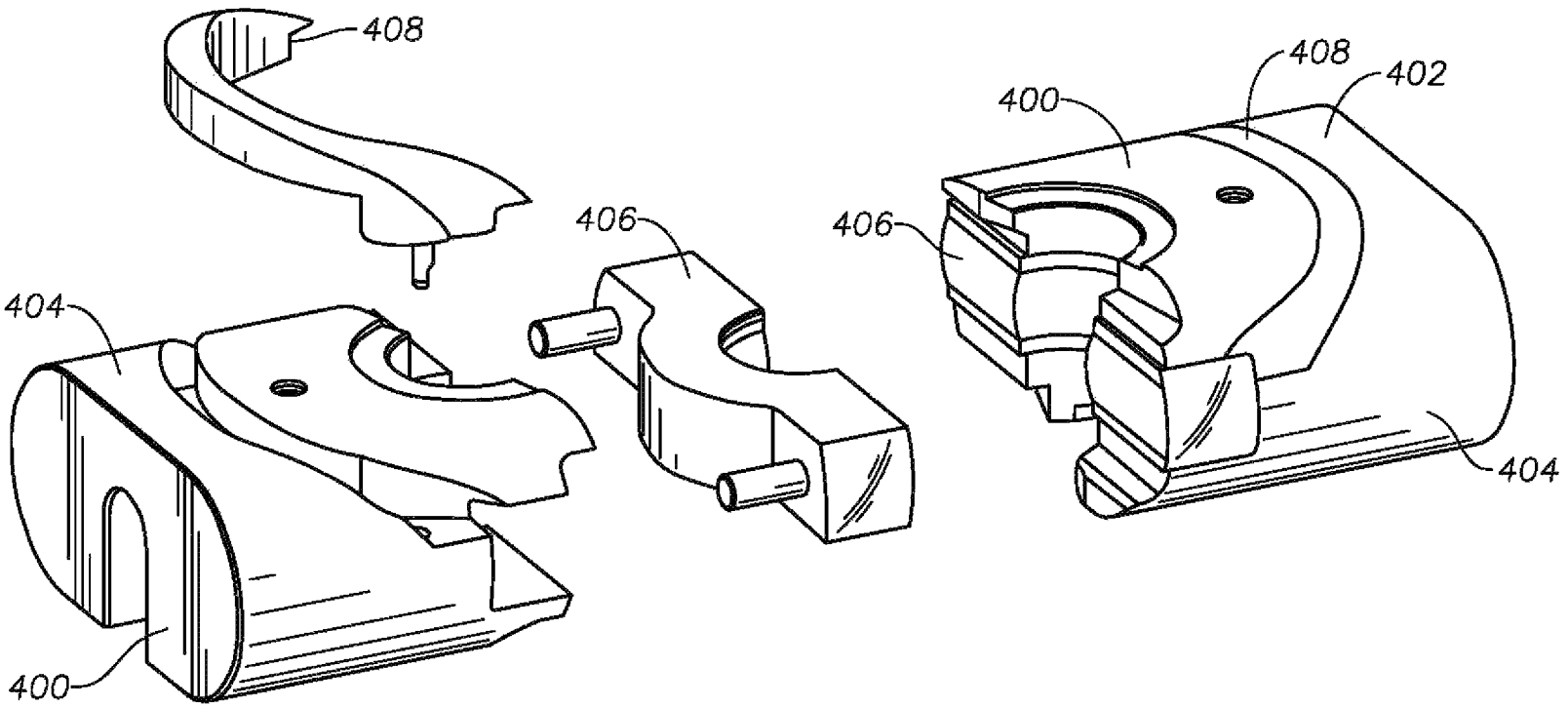
FIG. 4 shows an exploded view of the internal mechanism of a Ram Diverter.

FIG. 4 shows the internal configuration of one embodiment of a Ram Diverter 400. The ram 402 on one side is shown assembled, the ram 404 on the other side is shown as an exploded diagram. Contained within the body of the Ram Diverter 400 are the seal elements 406 and the upper seal 408.

The Ram Diverter 400 described herein is similar in concept to a pipe ram. It is, like a pipe ram, intended for use when the drill pipe is present. However, it is used very differently. A pipe ram is designed to be used only when the drill pipe is not rotating, and is intended to be used only as a safety device in an emergency, or during maintenance operations. It is referred to as a passive device. In contrast, the Ram Diverter 400 is intended to be used while drilling is in progress and while the drill pipe is rotating. That is, a diverter is an active device. Therefore the design has to allow for the rotational forces imparted by the drill pipe to the seal, and hence to the rams. The design also must allow for the wear on the seals which comes from the constant contact with the rotating drill pipe, or the upward and downward motion of the drill pipe. A further difference is that the Ram Diverter 400 is not intended to be used as a backup or secondary safety device, rather, it is located below the BOP stack to function as the primary well control barrier.

Figure 5:
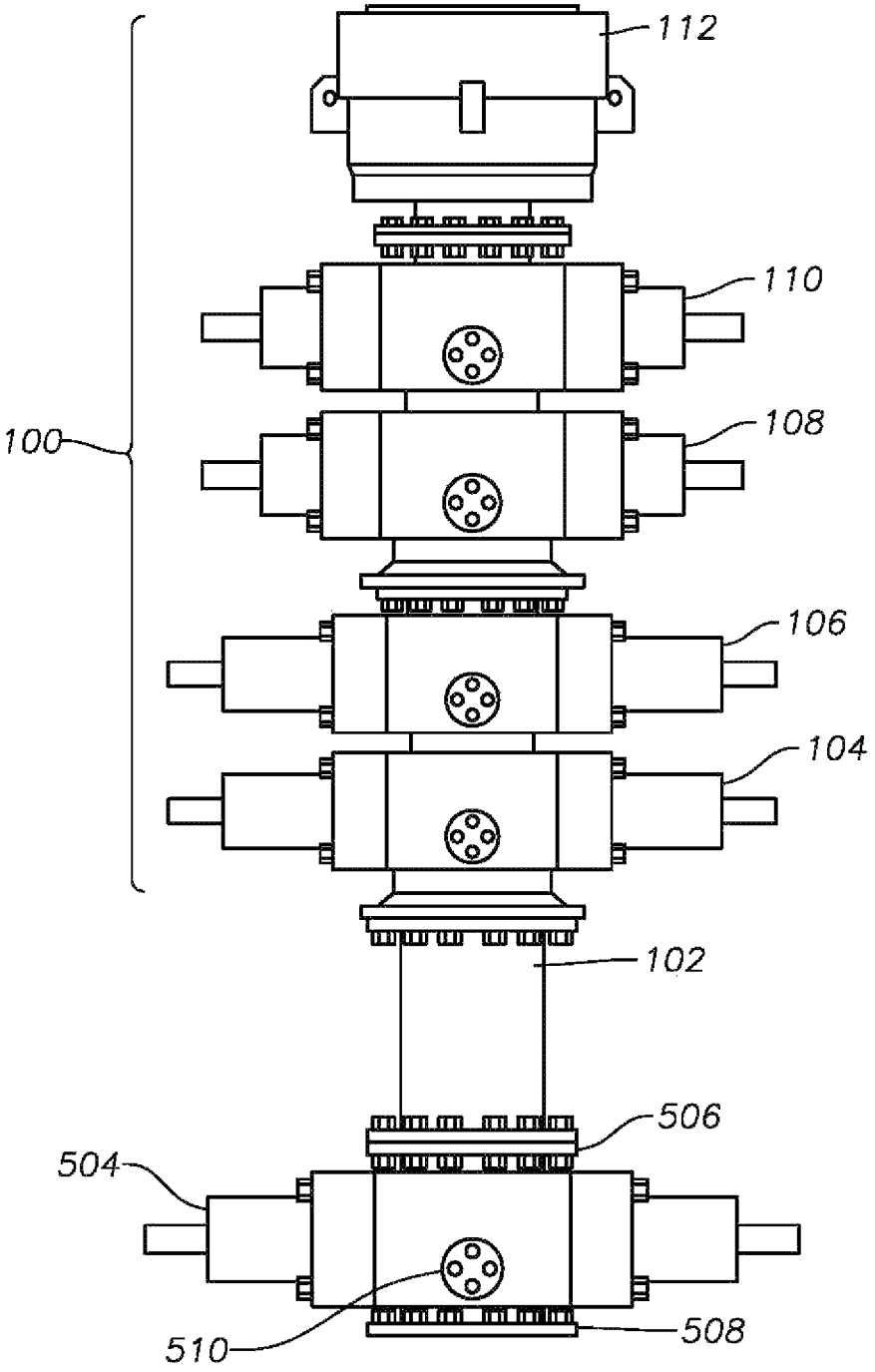
FIG. 5 shows a conventional blowout preventer stack with a Ram Diverter installed below the stack.

Turning now to FIG. 5, here is shown a conventional BOP 100 stack with a Ram Diverter 504 installed below it. The Ram Diverter 504 is equipped with an upper flange 506 and a lower flange 508 to enable it to be installed in a BOP stack with other industry standard devices. It must be emphasized that there will be no reservoir pressure in the conventional BOP stack 100 while drilling using the embodiments described herein. The high pressure will be contained below the Ram Diverter 504 while drilling. The present invention brings an additional increase in the safety of the drilling operation, as the Ram Diverter 504 is positioned below the rig floor at ground level. The drilling personnel are thus not working in close proximity to high pressure equipment.

To assist with maintenance operations, including changing the seal elements, some embodiments of the Ram Diverter are equipped with two threaded access ports 510, one on each side. The threaded access ports enable the installation of pressure gauges, and ball valves or needle valves to allow high pressures to be bled off after the devices are isolated and before the devices are opened. An alternative approach would be to install a spooler equipped with access ports between two devices for the same purpose.

Figure 6:
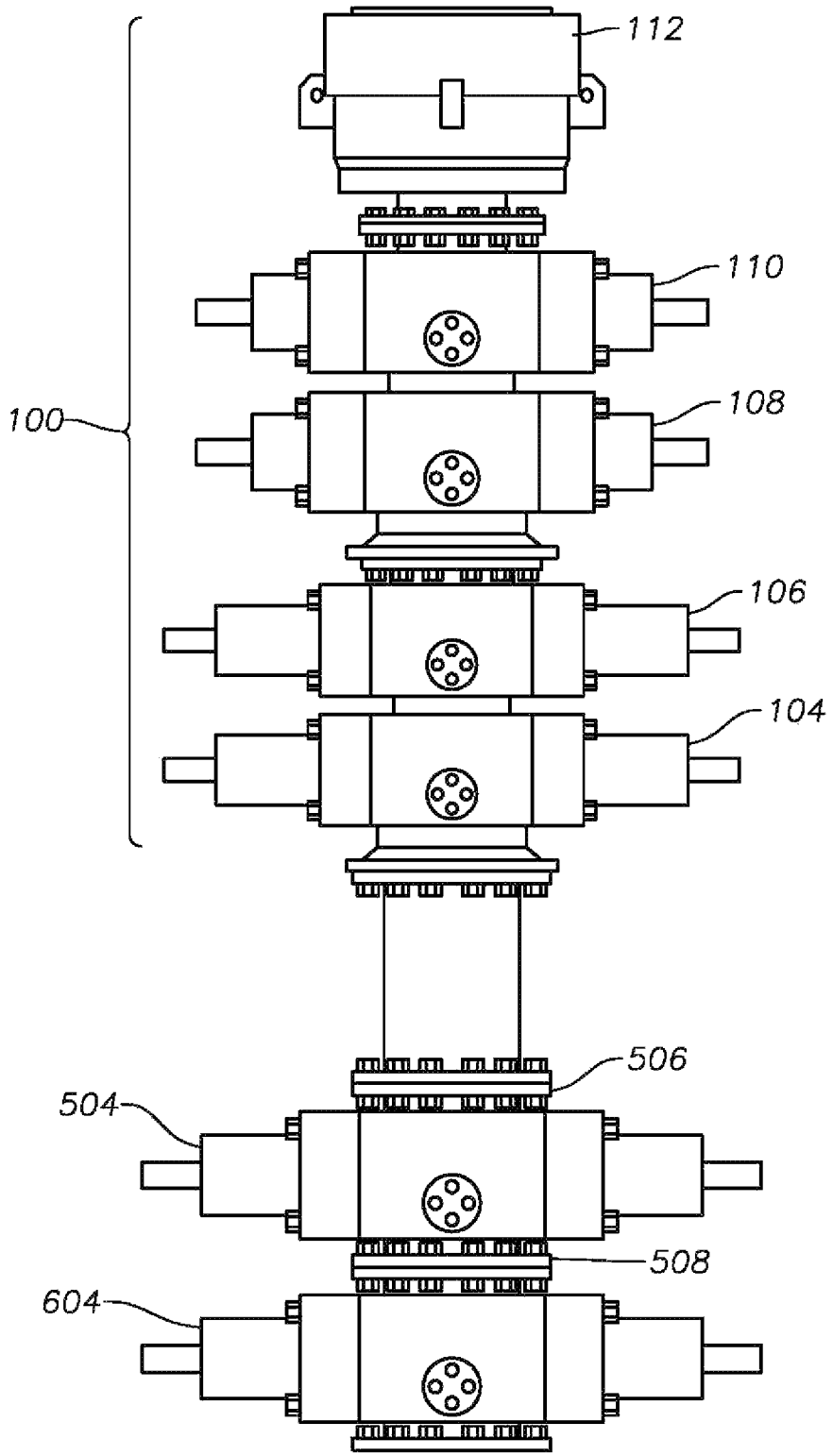
FIG. 6 shows a conventional blowout preventer stack with a Ram Diverter and a pipe ram installed below the stack.

In FIG. 6, a conventional pipe ram 604 is shown below the Ram Diverter 504. The pipe ram 604 can be closed to block the annulus 312 so as to isolate the Ram Diverter 504 from downhole pressure when changing the seals, and to provide yet another safety mechanism.

Figure 7:
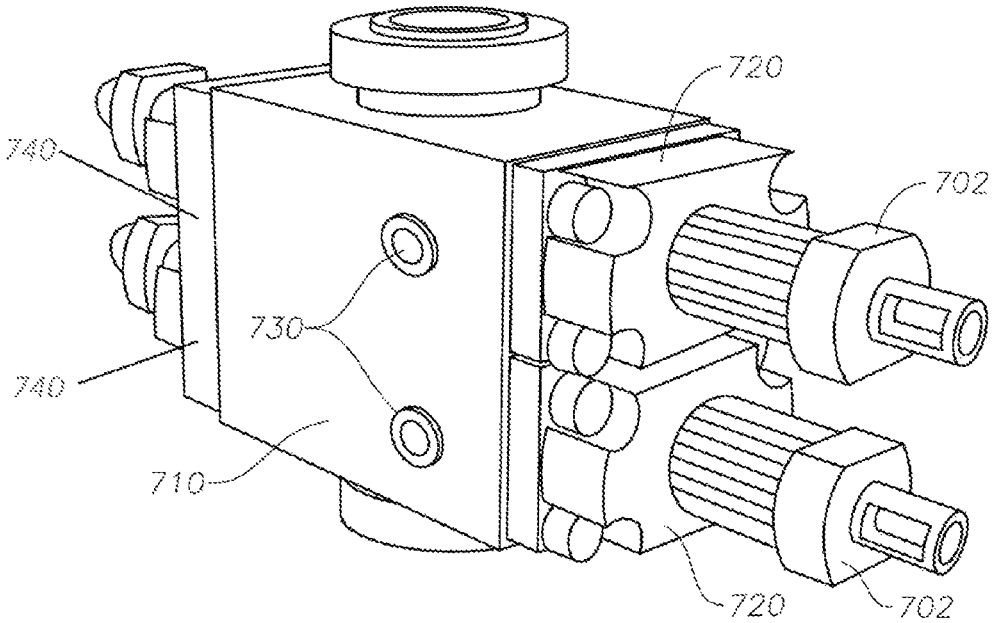
FIG. 7 shows a Ram Diverter and a pipe ram combined into one device.

As shown in FIG. 7, the Ram Diverter 702 and pipe ram 704 can be combined into one body 710 for compactness, thereby reducing the overall height of the BOP stack. Compactness is especially important when additional devices are being installed below the traditional BOP stack. The Ram Diverter 702 and pipe ram 704 have doors on each side of the body which can be opened to remove and replace the seal elements without having to remove any equipment above the device. Also shown are threaded access ports 730.

In order to optimize the drilling process and reduce downtime, some drilling operations may use two Annular Pressure Control Diverters, usually with a pipe ram installed below them. Drilling commences with only the upper Annular Pressure Control Diverter activated. When the seal in the upper Annular Pressure Control Diverter shows signs of wear, it is deactivated and the lower Annular Pressure Control Diverter is activated. Drilling continues essentially without interruption. This approach can be used with either annular diverters described in the '383 Patent, or Ram Diverters described herein.

Figure 8:
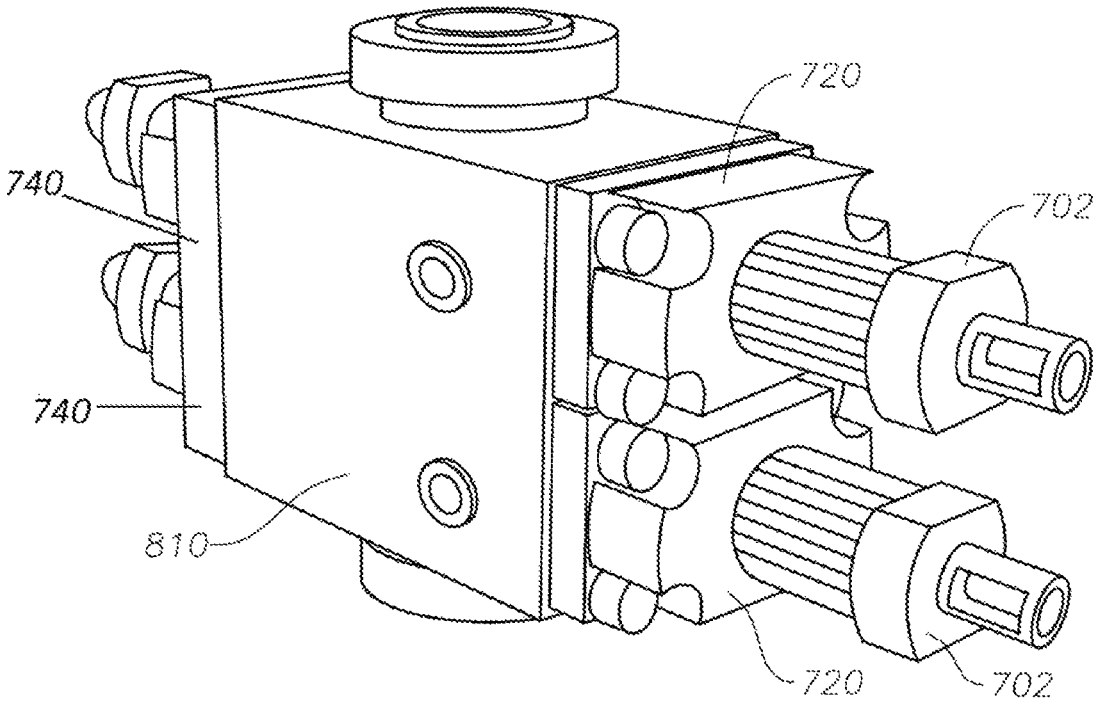
FIG. 8 shows two Ram Diverters combined into one device.

As with the Ram Diverter 702 and pipe ram 704, when two Ram Diverters 702 are used, they may be separate units, or as shown in FIG. 8, they may be combined into one body 810 for compactness. In other embodiments, the two Annular Pressure Control Diverters and a pipe ram may be combined into the same body for even greater compactness. The two Ram Diverters may have separate access doors 720, as shown in the configuration of FIG. 8. In other embodiments, the doors are combined so that the seals in both devices may be accessed in the same operation.

However, compactness is not the only factor which drives the choice of which devices to install. Some types of drill pipe connect sections using large joints, the external diameter of which is considerably larger than the external diameter of the drill pipe. In this case, there are advantages to separating the Ram Diverters, or the Ram Diverter and the pipe ram, by a sufficient vertical distance to allow the pipe joint to fully exit from one device before it encounters the next device as the pipe is lowered or raised.

It should be noted that the present invention is intended to be used together with pipe which has pipe joints significantly smaller than the industry norm. A typical 4" drill pipe may have joints with an external diameter of up to 5½". Such a large variation in diameter presents a problem when trying to pass the jointed drill pipe through a seal while maintaining a high pressure differential. As part of the overall approach to NBRD of which this device is part, the solution is to use drill pipe or tubing with connections having a reduced external diameter which is sometimes called flush joint pipe or near-flush joint pipe. When dealing with very large pressure differentials, the use of drill pipe with flush joints may be preferred. Alternatively, the lateral well may be drilled using casing as the drill pipe.

This drilling approach thus provides a double level of safety, as now there are the conventional BOP stack plus the additional diverter and pipe rams. The upper BOP stack is not normally under pressure, and no fluid normally flows through these devices, therefore there is no internal accumulation of detritus which might interfere with their operation in an emergency. Although the Ram Diverter and pipe ram are under pressure and are normally filled with drilling fluid, there is no fluid flowing through these devices, because the flow is diverted through the annulus 312. Therefore detritus from the cuttings will not accumulate in the Ram Diverter or the pipe ram below the diverter.

The present invention also addresses other problems encountered when using an underbalanced drilling approach with conventional equipment in a conventional configuration. One problem particularly seen in shales is formation damage caused in part by the high clay minerals content known as "fines" which can exceed 25% of the total volume of a shale formation. It is expected that there will be production while drilling underbalanced. Pressure will increase at the RCD 114 at the top of the conventional BOP stack 100, and the pressure can be and often is reduced by opening the drilling choke 120. This allows for an increase in the flow of hydrocarbons, and may result in the well being overproduced. The increased flow from the formation causes the migration of fines toward the wellbore, thereby damaging the permeability of the formation proximate to the well bore. All too often, the proposed solution to the drop in permeability is hydraulic fracturing. This makes the problem worse because clay fines are well known for swelling when contacted by water, thus blocking permeability even further.

In the present invention, the annulus 312 is sealed as described above, and the pressure and flow are diverted via flow line to a four-phase separator below ground level, while maintaining the underbalanced condition. Excess pressure buildup can be controlled using a choke valve to bleed off the pressure. This enables production while drilling without the damaging side effects caused by overproducing.

The critical component of any annular safety device is the seal. Because of these differences in how the Divert Ram is used, the design of the seal is even more important than in other ram devices. Like a pipe ram, but unlike a blind ram, the Ram Diverter is designed to operate when there is drill pipe in the BOP stack. The basic principle of operation is the same: opposing hydraulic rams force a flexible seal against the drill pipe, blocking the annulus around the drill pipe. But whereas a pipe ram operates when the drill pipe is not rotating, and not moving vertically, the Ram Diverter is designed to operate while the drill pipe is rotating and while drilling is in progress and the drill pipe is moving downwards as the drill bit advances. Therefore the internal seal in the Ram Diverter will be in continuous contact with the rotating drill pipe, causing wear on the seal.

A further major and significant difference is that the Ram Diverter is in continuous use as the primary pressure barrier, whereas a pipe ram is used as a secondary barrier for maintenance and well operations and for safety, but is not in continuous use while drilling.

The seal is constructed as two seal elements which fit together. The surfaces of the seal elements in contact with each other are manufactured with a pattern of raised bumps or nubbins and corresponding depressions such that they interlock securely. When the two parts of the seal are assembled together, they form a toroidal shape, having a center hole through which the drill pipe can pass.

In some embodiments of the present invention, the seal does not rotate. It is anticipated that the seal will wear during the course of the drilling operation. This is not an issue for several reasons. The device will only be activated when drilling into the reservoir. The Ram Diverter will not be in place during the drilling of the vertical section of the well. Once drilling of the vertical section and the transition curve is complete, the conventional BOP stack is removed and replaced by the BOP stack which includes the Ram Diverter. The wear will be minimal because the seal is made from polyurethane or similar materials, which have shown great resistance to wear, and to some extent are self-lubricating. In most cases drilling the lateral into the productive formation will only take a few days, and the seals will last long enough to accomplish the task.

Figure 9:
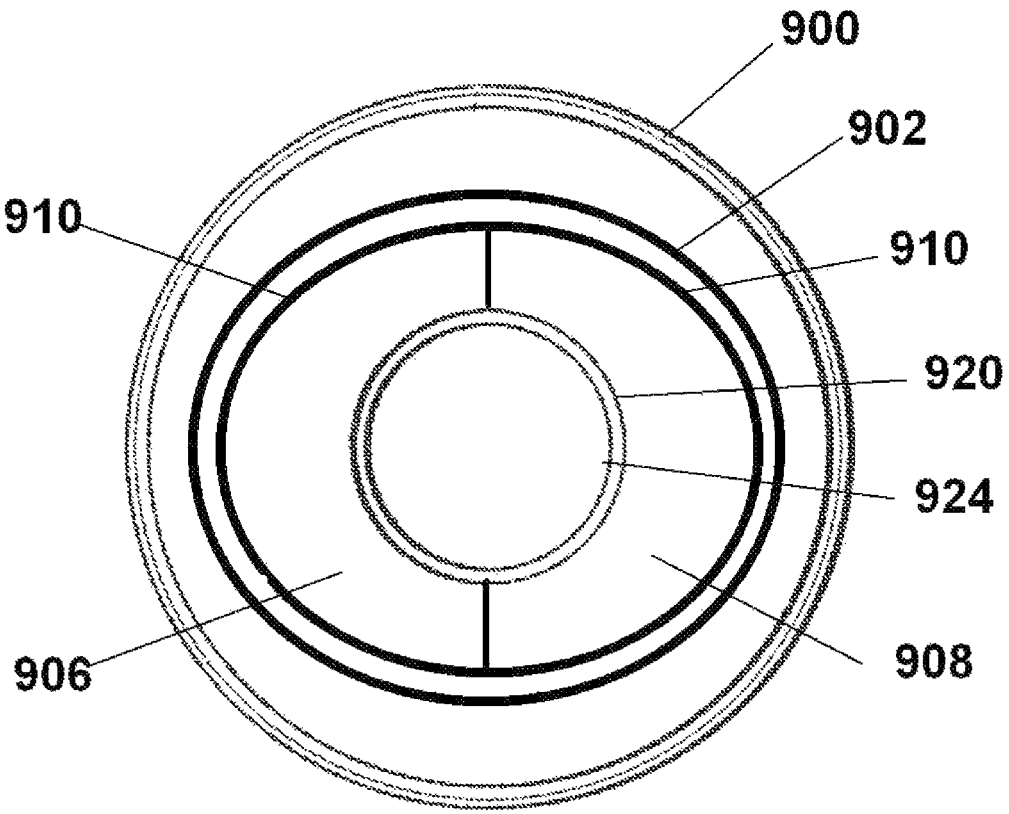
FIG. 9 shows a Ram Diverter with an elliptical internal cavity which prevents rotation of the seal elements.

A shown in FIG. 9A, in some embodiments wherein the seal does not rotate the internal cavity 902 of the Ram Diverter seal housing 900 is elongated to form an ellipse, and the seal elements 906. 908 have a precisely corresponding outer circumference 910 with an elliptical horizontal cross-section, thus preventing them from rotating within the elliptical internal cavity 902. This is contrasted with the circular seal and internal cavity in a conventional pipe ram. The inner circumference 920 of the seal elements 906, 908 is always circular to enable a tight seal around the circular drill pipe 924.

Figure 10A:
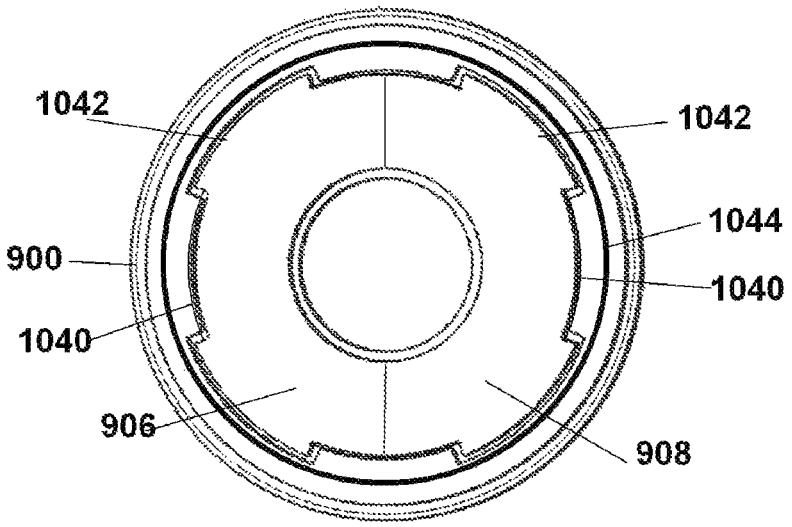
FIG. 10A shows the outer surfaces of the seal elements equipped with raised ridges which grip the inner surfaces of the seal housing to prevent rotation of the seal elements.

In some embodiments, as shown in FIG. 10A, the outer surfaces 1040 of the seal elements 906, 908, are equipped with raised ridges 1042 which grip the inner surfaces 1044 of the seal housing 900 to prevent rotation of the seal elements 906, 908.

Figure 10B:
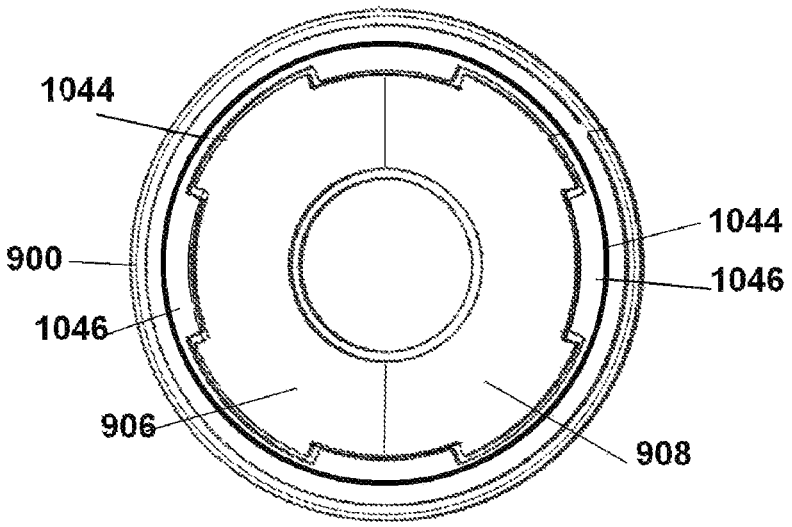
FIG. 10B shows the inner surfaces of the seal housing equipped with raised ridges which grip the outer surfaces of the seal elements to prevent rotation of the seal elements

In some embodiments, as shown in FIG. 10B, the inner surfaces 1044 of the seal housing 900 are equipped with raised ridges 1046 which grip the outer surfaces 1040 of the seal elements 906, 908, to prevent rotation of the seal elements 906, 908.

Figure 11A:
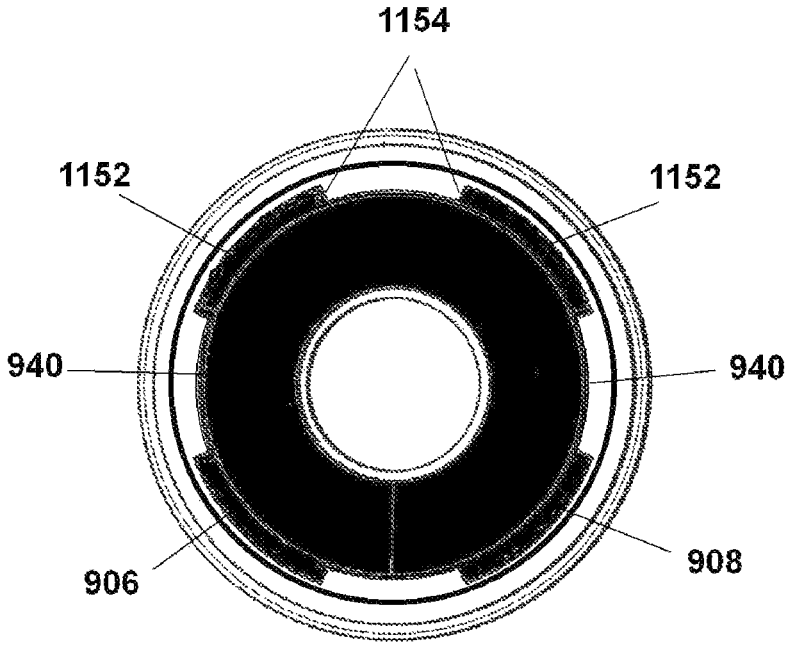
FIG. 11A shows the outer surfaces of the seal elements equipped with raised ridges which interlock with grooves on the inner surfaces of the seal housing to prevent rotation of the seal elements.

In some embodiments, as shown in FIG. 11A, the outer surfaces 940 of the seal elements 906, 908 are equipped with raised ridges 1152 which interlock with grooves 1154 on the inner surfaces 1044 of the seal housing 900 to prevent rotation of the seal elements 906, 908.

Figure 11B:
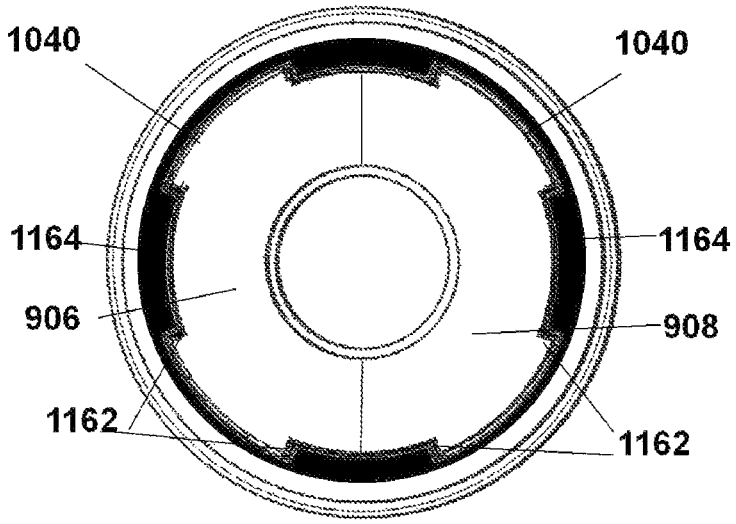
FIG. 11B shows the outer surfaces of the seal elements equipped with grooves which interlock with ridges on the inner surfaces of the seal housing to prevent rotation of the seal elements.

In other embodiments, as shown in FIG. 11B, the outer surfaces 940 of the seal elements 906, 908 are equipped with grooves 1162 which interlock with ridges 1164 on the inner surfaces 1044 of the seal housing 900 to prevent rotation of the seal elements 906, 908.

In some embodiments, the seal elements comprise a flexible polyurethane member bonded to a metal backing. One of ordinary skill in the art will understand that polyurethane to metal bonds are extremely strong. The bonded assembly is then installed inside the internal cavity 902 of the Ram Diverter seal housing 900. The above methods, including an elliptical internal cavity 902, and the ridge-groove approaches, may be employed to ensure that the bonded assembly does not rotate within the internal cavity 902 when the drill pipe 924 is rotating.

In some embodiments, the seal elements contain metal inserts to provide additional rigidity and resistance to torsional forces.

In some embodiments, the pistons of the hydraulic cylinders of the ram are reinforced to resist the torsional forces exerted through the seal and seal housing into the pistons when the drill pipe is rotating.

In some embodiments, the seal housing is modified with flanges at the upper and lower ends to prevent the seal being distorted by the drill pipe as the drill pipe is lowered or raised.

The seal elements have, in certain embodiments, tapered shoulders at the upper and lower corners next to the drill pipe. The taper will better accept a tool joint that does have a 90° shoulder. This will enable the larger tool joint to more easily enter the seal, reducing stress and wear on the seal elements.

The Ram Diverter may also be configured in some embodiments with a seal which does rotate with the drill pipe. While this eliminates wear on the inner surfaces of the seal elements, the wear will instead occur on the outer surfaces of the seal elements as they rotate within the ram. The upper and lower surfaces of the seal elements will also wear, which may require that bearings be installed above and below the seal elements, as was done with the RCD devices for the same reason. The non-rotating seal is the preferred embodiment because of issues with rotating a two part seal and additional complexity in removing and replacing the seal.

The Ram Diverter can accommodate different sizes of drill pipe by changing the seal elements. Given the properties of the polyurethane from which the elements are made, the flexible seals can accommodate a reasonable range of drill pipe diameter sizes and pipe connection sizes without needing to be changed. Some embodiments of the seal elements are capable of closing down the center hole even with no drill pipe present.

Polyurethane has properties which make it especially suitable for this application. It is highly compressible, but also has the ability to regain its original shape when the compression is released. It is also highly stretchable, being able to extend in some cases to up to six times its normal dimension and again has the ability to quickly revert to its original shape. It is resistant to wear. Different types of polyurethane have varying resistance to high temperatures, so it is easy to obtain the right type for a given application. And of course, it is not affected by oil and gas.

In some embodiments, the seal elements are constructed with different composition polyurethane on the edges and the center. This is done to help prevent rotation. The seal elements may have hard outer circumference, which provides resistance to deformation of the seal by the torque transmitted from the rotating drill pipe, rotation, combined with a softer inner section, which allows the drill pipe to rotate within the seal with less abrasion and wear. In other embodiments, the seal elements have a hard lower section, again to resist rotation. These features may be combined into seals with a hard outer circumference and a hard lower section, and a softer upper central section.

In some embodiments, there is a cut away section in the middle of the seal elements. This allows some relief as a pipe joint passes through the seal elements. If it were not for this cut away, the pipe joint would drag on the seal elements, deforming them and potentially causing wear and damage. Will need to illustrate.

In the embodiments where there are two Ram Diverters in one unit, as in FIG. 8, there may be separate seal elements for each Ram Diverter, or the seal may be manufactured to cover the two Ram Diverters and the intervening space. The latter embodiment would require that the double device have a single door providing access to the entire interior space.

In some drilling operations, it may be necessary to change the seal elements, or to inspect them for safety reasons. This can only be done when the pressure inside the Ram Diverter has been released. Doing so requires the operation of downhole safety valves or an annular or pipe ram BOP below the Ram Diverter to isolate the Ram Diverter from pressure in the wellbore, to ensure that the pressure within the Ram Diverter can be lowered to atmospheric pressure while maintaining control of the well. Or, as mentioned previously, when two Ram Diverters are installed, the lower Ram Diverter can be activated to isolate the upper Ram Diverter.

The Ram Diverter may be required to operate under a wide range of conditions, and therefore is designed to be easily customized in the field. The seal elements can be made with different polyurethane compounds with varying levels of compressibility. The dimensions of the seal elements may be varied. The thickness of the walls may be changed. These changes affect the interior volume which can be occupied by the seal elements as they are compressed, and allow the Ram Diverter to accommodate different sizes of drill pipe. These parameters can also be adjusted to configure the Ram Diverter to handle different downhole pressures. The hydraulic cylinders which compress the seal elements can be changed, longer cylinders providing more compressibility, for example.

In addition to the Annular Pressure Control Diverter described herein, additional safety valves, BOPs, RCDs, pipe rams, blind rams and shear rams may also be installed to meet the needs of the drilling operation, company policies, and any applicable safety regulations.

The above disclosure sets forth a number of embodiments of the present invention described in detail with respect to the accompanying drawings. Those skilled in this art will appreciate that various changes, modifications, other structural arrangements, and other embodiments could be practiced under the teachings of the present invention without departing from the scope of this invention as set forth in the following claims.

What is claimed is:

1. An Annular Pressure Control Ram Diverter for use during the drilling of a well to seal the annulus between a drill pipe and a casing surrounding the drill pipe while the drill pipe is rotating or stationary in order to divert the flow of returned drilling and produced fluids into an outer annulus, comprising:

a ram blowout preventer;

an internal cavity forming a seal housing within the ram blowout preventer;

flexible seal elements contained within the seal housing;

wherein the flexible seal elements close around the drill pipe while the drill pipe is rotating or stationary to block and seal the annulus between the drill pipe and the casing;

wherein raised ridges which form a gripping surface are used to prevent rotation of the seal elements and wherein the outer surfaces of the flexible seal elements are equipped with raised ridges which grip the inner surfaces of the seal housing to prevent rotation of the seal elements.

2. An Annular Pressure Control Ram Diverter for use during the drilling of a well to seal the annulus between a drill pipe and a casing surrounding the drill pipe while the drill pipe is rotating or stationary in order to divert the flow of returned drilling and produced fluids into an outer annulus, comprising:

a ram blowout preventer;

an internal cavity forming a seal housing within the ram blowout preventer;

flexible seal elements contained within the seal housing;

wherein the flexible seal elements close around the drill pipe while the drill pipe is rotating or stationary to block and seal the annulus between the drill pipe and the casing;

wherein raised ridges which form a gripping surface are used to prevent rotation of the seal elements and wherein the inner surfaces of the seal housing are equipped with raised ridges which grip the outer surfaces of the seal elements to prevent rotation of the seal elements.

3. An Annular Pressure Control Ram Diverter for use during the drilling of a well to seal the annulus between a drill pipe and a casing surrounding the drill pipe while the drill pipe is rotating or stationary in order to divert the flow of returned drilling and produced fluids into an outer annulus, comprising:

a ram blowout preventer;

an internal cavity forming a seal housing within the ram blowout preventer;

flexible seal elements contained within the seal housing;

wherein the flexible seal elements close around the drill pipe while the drill pipe is rotating or stationary to block and seal the annulus between the drill pipe and the casing;

wherein interlocking grooves and ridges are used to prevent rotation of the seal elements and wherein the outer surfaces of the flexible seal elements are equipped with grooves which interlock with raised ridges on the inner surfaces of the seal housing to prevent rotation of the seal elements.

* * * * *